US010661956B2

(12) United States Patent
Helseth

(10) Patent No.: US 10,661,956 B2
(45) **Date of Patent: *May 26, 2020**

(54) TWIST-TIE DISPENSER REFILL

(71) Applicant: Twist-Ease, Inc., Crystal, MN (US)

(72) Inventor: James R. Helseth, Plymouth, MN (US)

(73) Assignee: Twist-Ease, Inc., Crystal, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/197,541

(22) Filed: Nov. 21, 2018

(65) Prior Publication Data

US 2019/0202616 A1 Jul. 4, 2019

Related U.S. Application Data

(63) Continuation of application No. 15/281,385, filed on Sep. 30, 2016, now Pat. No. 10,138,039, which is a continuation of application No. 14/329,611, filed on Jul. 11, 2014, now Pat. No. 9,486,092.

(60) Provisional application No. 61/845,568, filed on Jul. 12, 2013.

(51) Int. Cl.

| | |
|---|---|
| ***B65D 73/00*** | (2006.01) |
| ***A47F 13/04*** | (2006.01) |
| ***A47F 13/00*** | (2006.01) |
| ***B65D 63/12*** | (2006.01) |
| ***B65D 65/46*** | (2006.01) |

(52) U.S. Cl.

CPC ..... *B65D 73/0014* (2013.01); *A47F 13/00* (2013.01); *A47F 13/04* (2013.01); *B65D 63/12* (2013.01); *B65D 65/466* (2013.01); *B65D 73/0028* (2013.01); *H05K 999/99* (2013.01)

(58) Field of Classification Search

CPC .. A47F 3/02; A47F 13/00; A47F 13/04; A47F 13/08; B31D 1/00; B65D 63/12; B65D 65/46; B65D 65/466; B65D 73/00; B65D 73/0014; B65D 73/0028

See application file for complete search history.

(56) References Cited

U.S. PATENT DOCUMENTS

| | | | |
|---|---|---|---|
| 628,642 | A | 7/1899 | Wyman |
| 740,001 | A | 9/1903 | Flanagin |
| 1,441,359 | A | 1/1923 | Langston |
| 2,050,394 | A | 8/1936 | Straubel |
| D156,922 | S | 1/1950 | Sonntag |
| 2,973,597 | A | 3/1961 | Powell |
| 2,984,161 | A | 5/1961 | Cook et al. |
| 3,068,135 | A | 12/1962 | Bower |
| 3,207,564 | A | 9/1965 | Patrick et al. |
| 3,290,854 | A | 12/1966 | MacMurray |
| 3,409,948 | A | 11/1968 | Goodwin |
| 3,774,755 | A | 11/1973 | Cast et al. |
| 4,052,886 | A | 10/1977 | Buick |
| D261,452 | S | 10/1981 | Chandler |
| 4,509,231 | A | 4/1985 | Paxton |
| 4,537,330 | A | 8/1985 | Gelbard |
| 4,539,237 | A | 9/1985 | Clayton |
| 4,543,862 | A | 10/1985 | Levene et al. |

(Continued)

*Primary Examiner* — Bryon P Gehman

(74) *Attorney, Agent, or Firm* — Merchant & Gould P.C.

(57) ABSTRACT

A twist-tie dispenser refill comprises a twist-tie cluster and a base. The twist-tie cluster includes a top cluster portion. The base includes a top portion, which is generally U-shaped and forms an opening configured and arranged to receive the top cluster portion of the twist-tie cluster. The base also includes a rear portion that defines mounting members used for mounting the base to a fixture.

9 Claims, 18 Drawing Sheets

(56) References Cited

U.S. PATENT DOCUMENTS

| | | | |
|---|---|---|---|
| 4,558,813 | A | 12/1985 | Richards |
| 4,596,195 | A | 6/1986 | Wenger |
| D285,719 | S | 9/1986 | Conlon |
| 4,621,732 | A | 11/1986 | Olson |
| D294,908 | S | 3/1988 | Childress |
| 4,815,610 | A | 3/1989 | Borick et al. |
| 4,948,202 | A | 8/1990 | Helseth |
| D323,594 | S | 2/1992 | Helseth |
| 5,092,830 | A | 3/1992 | Helseth |
| 5,213,400 | A | 5/1993 | Helseth |
| 5,232,431 | A | 8/1993 | Helseth |
| D395,566 | S | 6/1998 | Helseth |
| 5,961,434 | A | 10/1999 | Helseth |
| 6,217,500 | B1 | 4/2001 | Helseth |

TWIST-TIE DISPENSER REFILL

CROSS REFERENCE TO RELATED APPLICATION(S)

This application is a continuation of U.S. Non-Provisional application Ser. No. 15/281,385, filed on Sep. 30, 2016, now U.S. Pat. No. 10,138,039; which is a continuation of U.S. Non-Provisional application Ser. No. 14/329,611, filed on Jun. 11, 2014, now U.S. Pat. No. 9,486,092; which claims the benefit of U.S. Provisional Application No. 61/845,568, filed on Jul. 12, 2014, which applications are hereby incorporated by reference in their entireties.

FIELD OF THE INVENTION

The present invention relates generally to a twist-tie dispenser refill.

BACKGROUND OF THE INVENTION

There are many uses for twist-ties. In a grocery store, for example, consumers commonly place produce items, bakery items, bulk food items, and the like in bags and use twist-ties to temporarily close the bags. In such uses, sanitary conditions are very important and, therefore, consideration should be given to the manner in which the twist-ties are dispensed. Further, spillage of twist-ties is a concern for safety reasons among others.

For the reasons stated above and for other reasons stated below, which will become apparent to those skilled in the art upon reading and understanding the present specification, there is a need in the art for an improved twist-tie dispenser refill.

BRIEF SUMMARY OF THE INVENTION

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In one embodiment, a twist-tie dispenser refill comprises a twist-tie cluster and a base. The twist-tie cluster includes a top cluster portion. The base includes a top portion, which is generally U-shaped and forms an opening configured and arranged to receive the top cluster portion of the twist-tie cluster. The base also includes a rear portion that defines mounting members used for mounting the base to a fixture.

According to one example embodiment, the mounting members may be defined by hook-like extensions that protrude from the rear portion of the base, wherein the hook-like extensions are configured to receive elongate, rod-like mounting structures of a fixture to which the twist-tie dispenser refill is to be mounted. According to one example, the hook-like extensions may be snap-fit over the elongate, rod-like mounting structures of the fixture.

According to another example embodiment, the base may define flexible cantilever tabs that block the pockets formed by the hook-like extensions of the base. The cantilever tabs are configured so as to be elastically flexed out of the way when receiving the elongate rod-like mounting structures into the pockets and prevent or limit removal therefrom.

BRIEF DESCRIPTION OF THE DRAWINGS

The present invention can be more easily understood, and further advantages and uses thereof can be more readily apparent, when considered in view of the detailed description and the following Figures in which:

FIG. 27 illustrates an example embodiment of a fixture to which twist-tie dispenser refills such as those shown in FIGS. 15-25 may be mounted to.

In accordance with common practice, the various described features are not drawn to scale but are drawn to emphasize specific features relevant to the present invention. Reference characters denote like elements throughout the Figures and the text.

DETAILED DESCRIPTION OF THE INVENTION

In the following detailed description, reference is made to the accompanying drawings, which form a part hereof, and in which is shown by way of illustration, embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

Embodiments of the present invention provide improved twist-tie dispenser refills.

Figure 1:
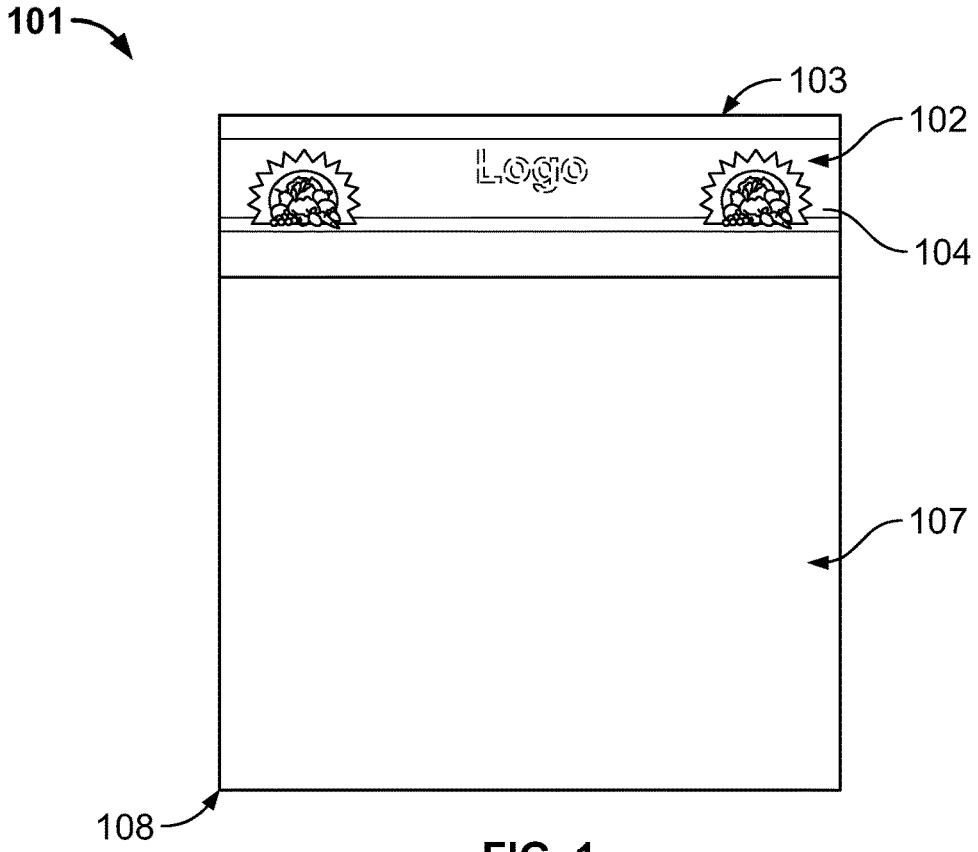
FIG. 1 is a front view of a base of a twist-tie dispenser refill.
Figure 2:
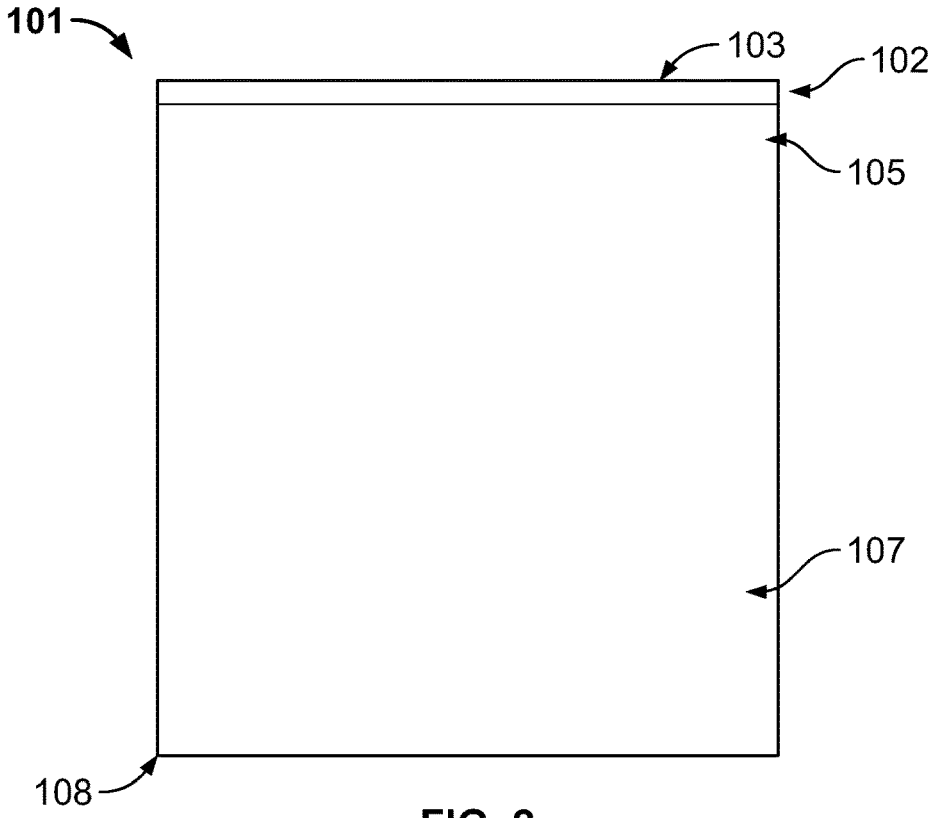
FIG. 2 is a rear view of the base shown in FIG. 1.
Figure 3:
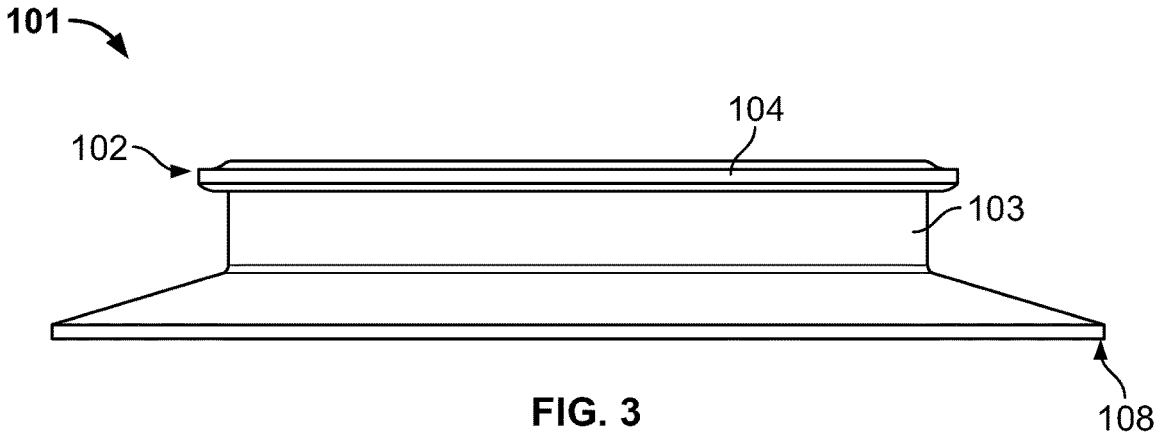
FIG. 3 is a bottom view of the base shown in FIG. 1.
Figure 4:
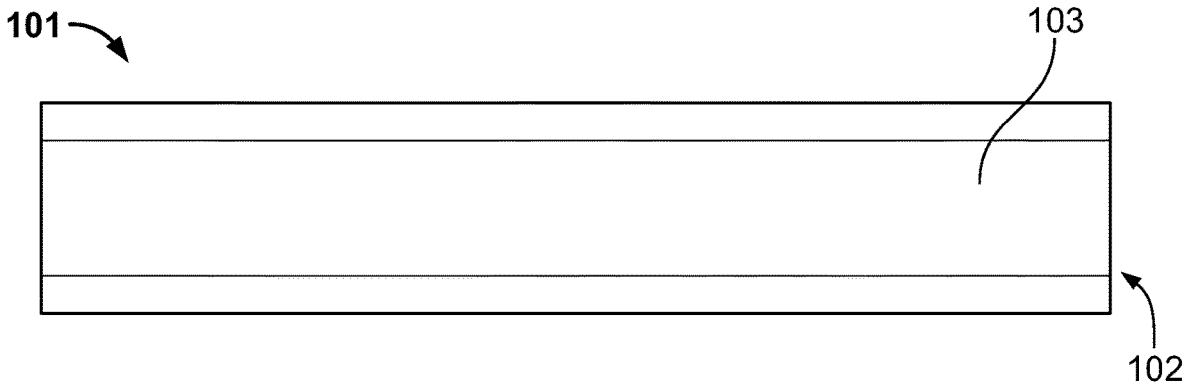
FIG. 4 is a top view of the base shown in FIG. 1.
Figure 5:
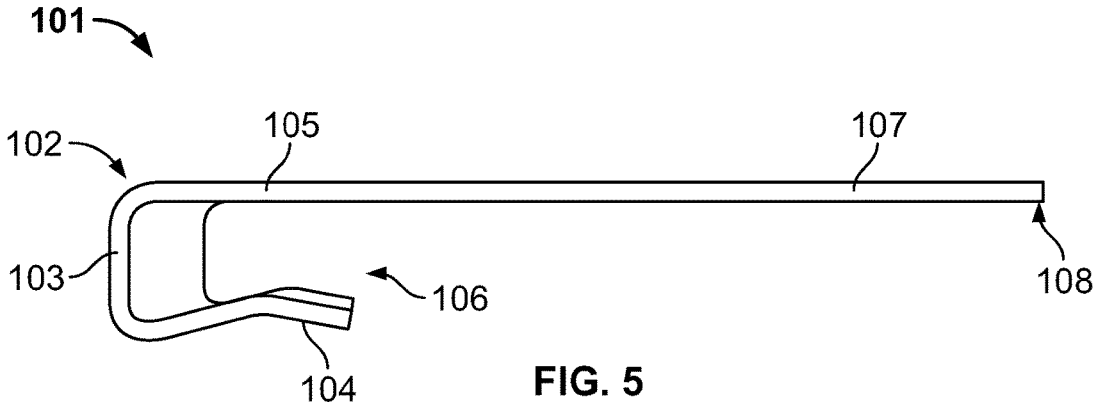
FIG. 5 is a side view of the base shown in FIG. 1.
Figure 6:
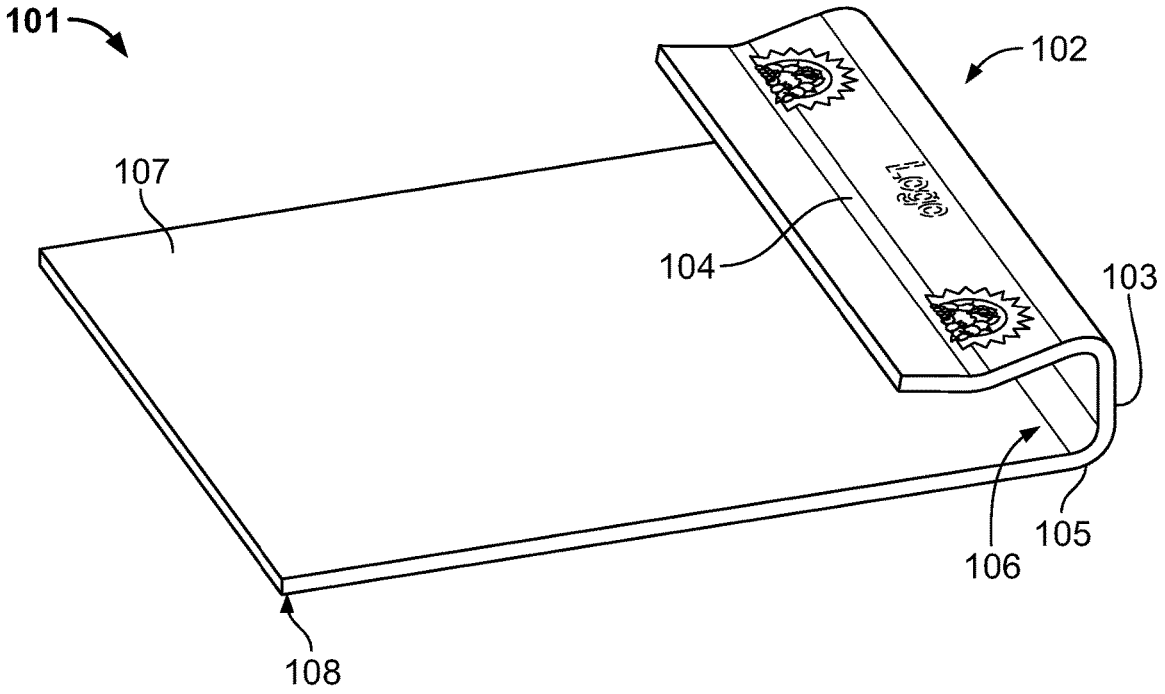
FIG. 6 is a side perspective view of the base shown in FIG. 1.
Figure 7:
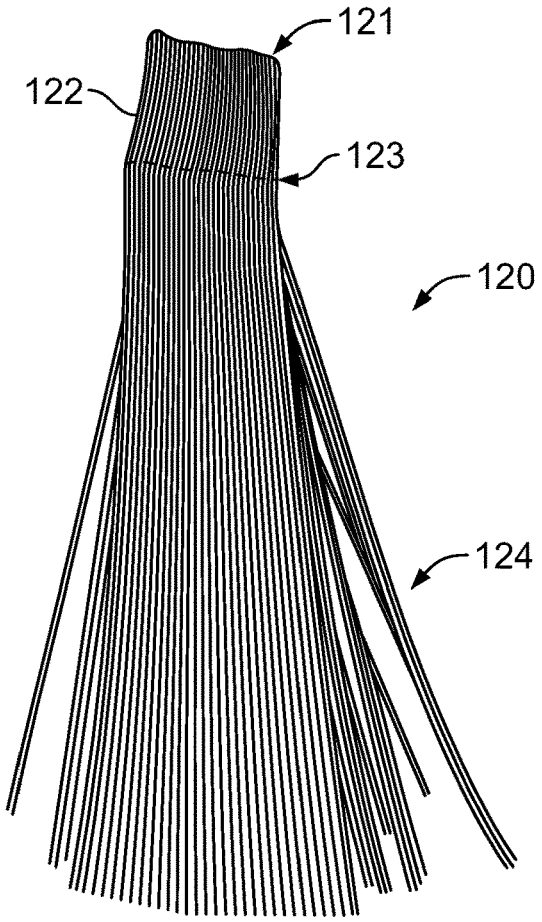
FIG. 7 is a side view of a twist-tie cluster of the twist-tie dispenser refill.
Figure 8:
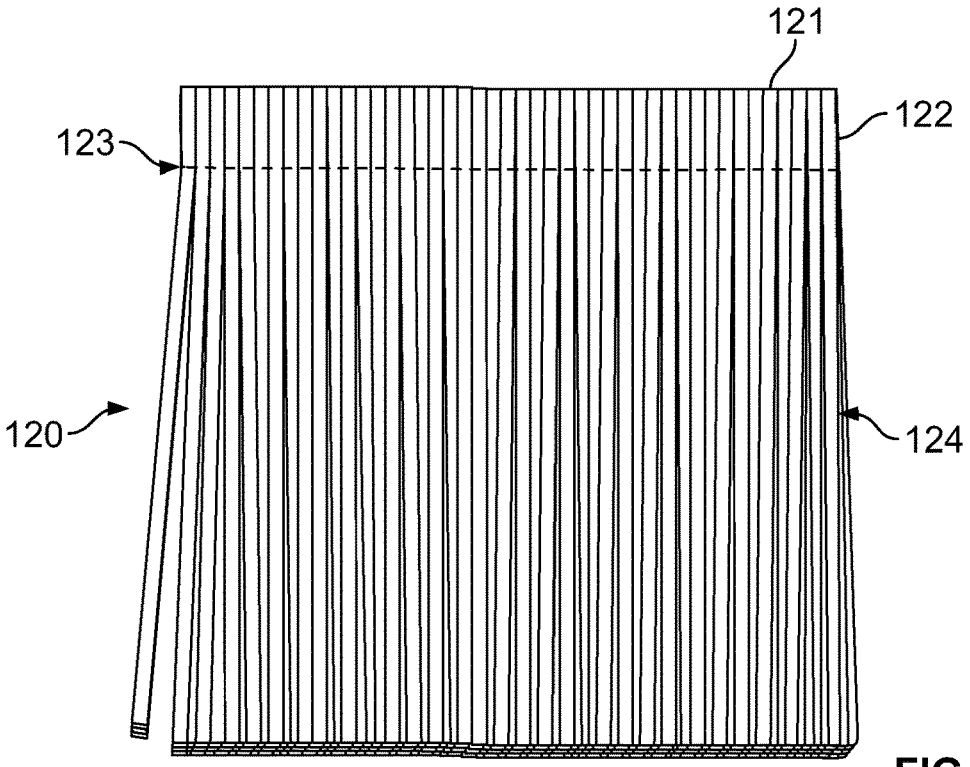
FIG. 8 is a front view of the twist-tie cluster shown in FIG. 7.
Figure 9:
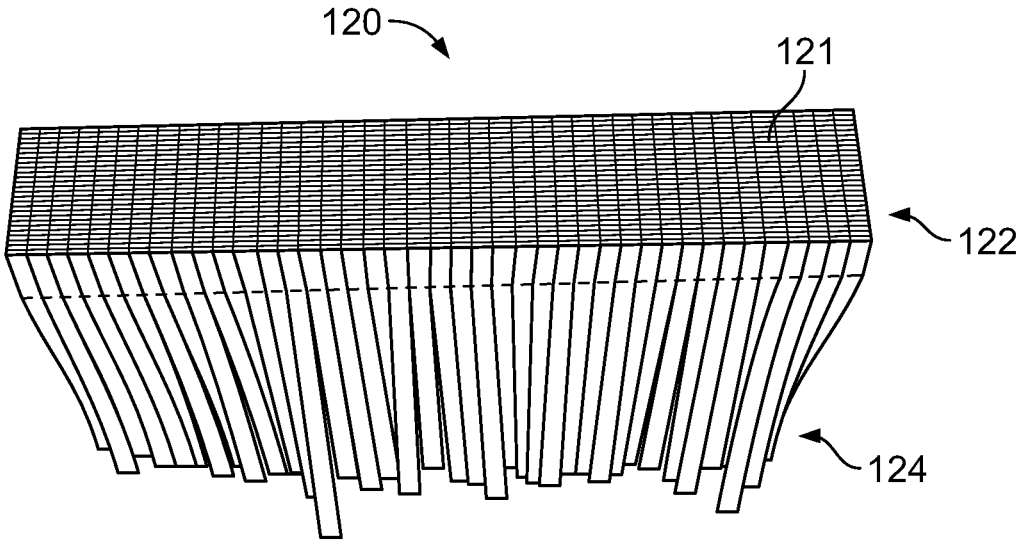
FIG. 9 is a top view of the twist-tie cluster shown in FIG. 7.
Figure 10:
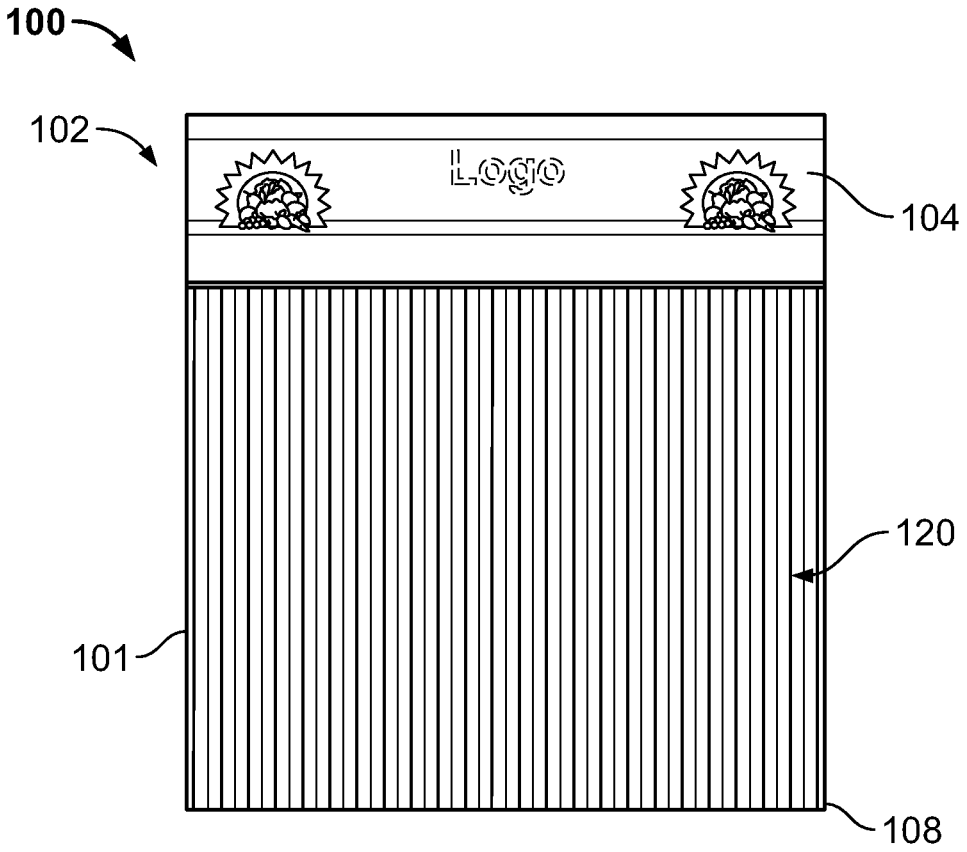
FIG. 10 is a front view of the twist-tie dispenser refill.
Figure 11:
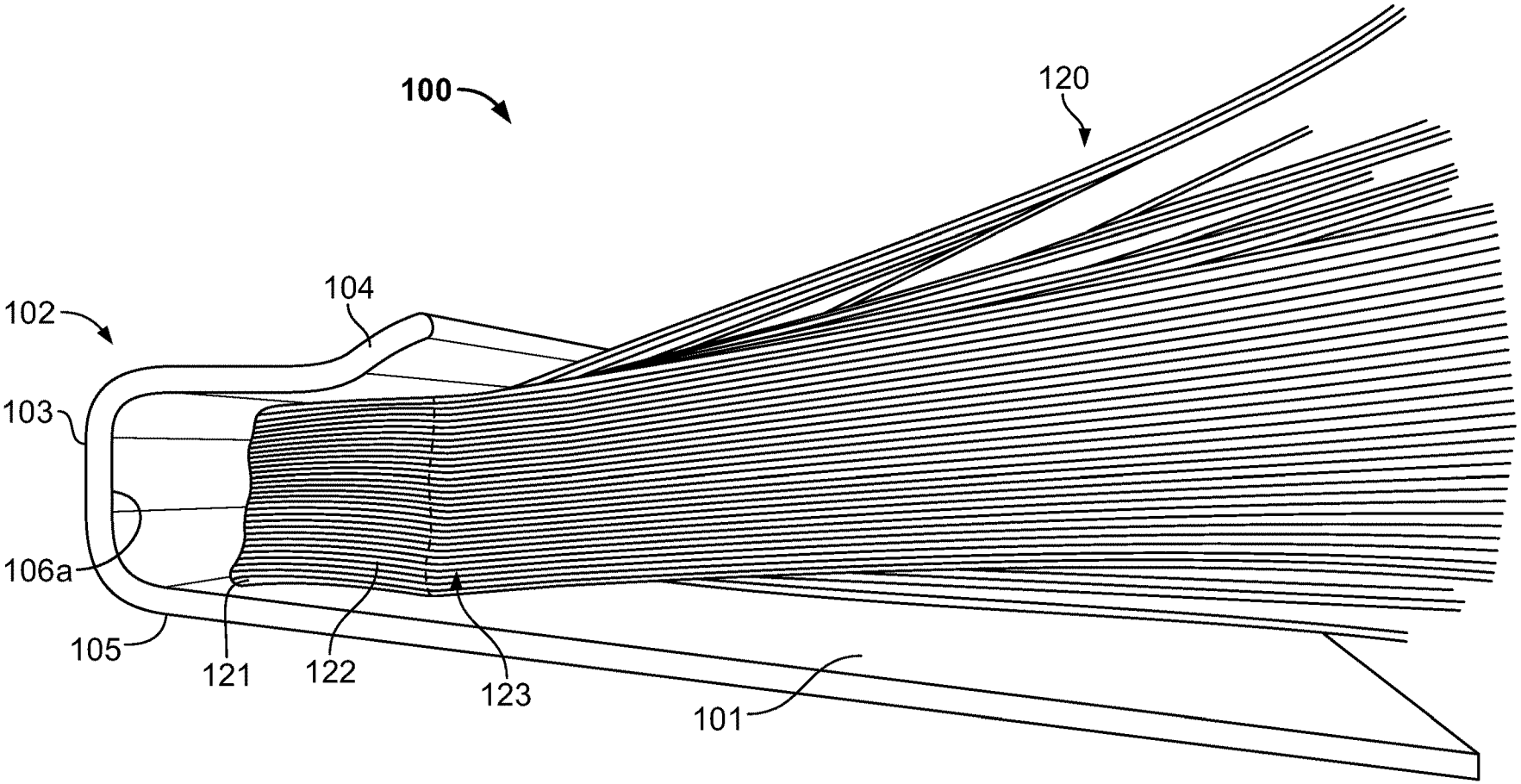
FIG. 11 is a side view of the twist-tie dispenser refill shown in FIG. 10.

One embodiment twist-tie dispenser refill 100 includes a base 101 and a twist-tie cluster 120, which are shown in FIGS. 1-11. The base 101 includes a generally U-shaped top portion 102 and a rear portion 107. The top portion 102 includes a top 103 interconnecting a front 104 and a rear 105, which form an opening 106 therebetween. Preferably, the front 104 has a generally concave portion, which is shown in FIG. 5. The rear portion 107 extends downward from the rear 105 of the top portion 102, and the rear portion 107 includes a bottom 108. The base 101 could be made of extruded plastic and optionally be at least partially covered with paper, which could include graphics such as logos, trademarks, advertising, and the like. The base 101 could also be made of corrugated cardboard or any other suitable material.

The twist-tie cluster 120 includes a plurality of twist-ties interconnected by a connecting member 121 such as an adhesive proximate a top portion 122 of the cluster. The top portion 122 and a dispense portion 124 are separated by a perforated portion 123, which allows for individual twist-ties of the dispense portion 124 to be easily dispensed therefrom, leaving portions of the twist-ties in the top portion 122, proximate between the connecting member 121 and the perforated portion 123.

The generally U-shaped top portion 102 of the base 101 is configured and arranged to receive within the opening 106 the top portion 122 of the twist-tie cluster 120, which may be friction fit within the generally U-shaped top portion 122 and/or otherwise secured therein with a securing member such as an adhesive, at least one staple, at least one rivet, or the like so that the base 101 is in effect integral with the twist-tie cluster 120. The base is preferably somewhat elastic or flexible in that at least one of the top 103 and the front 104 can be moved relative to the rear 105 to receive the top portion 122 of the twist-tie cluster 120. The generally concave portion of the front 104 assists with the friction fit. A bottom portion of the twist-tie cluster 120, which is a plurality of twist-ties that are not connected, is the dispense portion 124 that is exposed proximate at least a front of the base 101 to allow a user to take one of the twist-ties.

Figure 12:
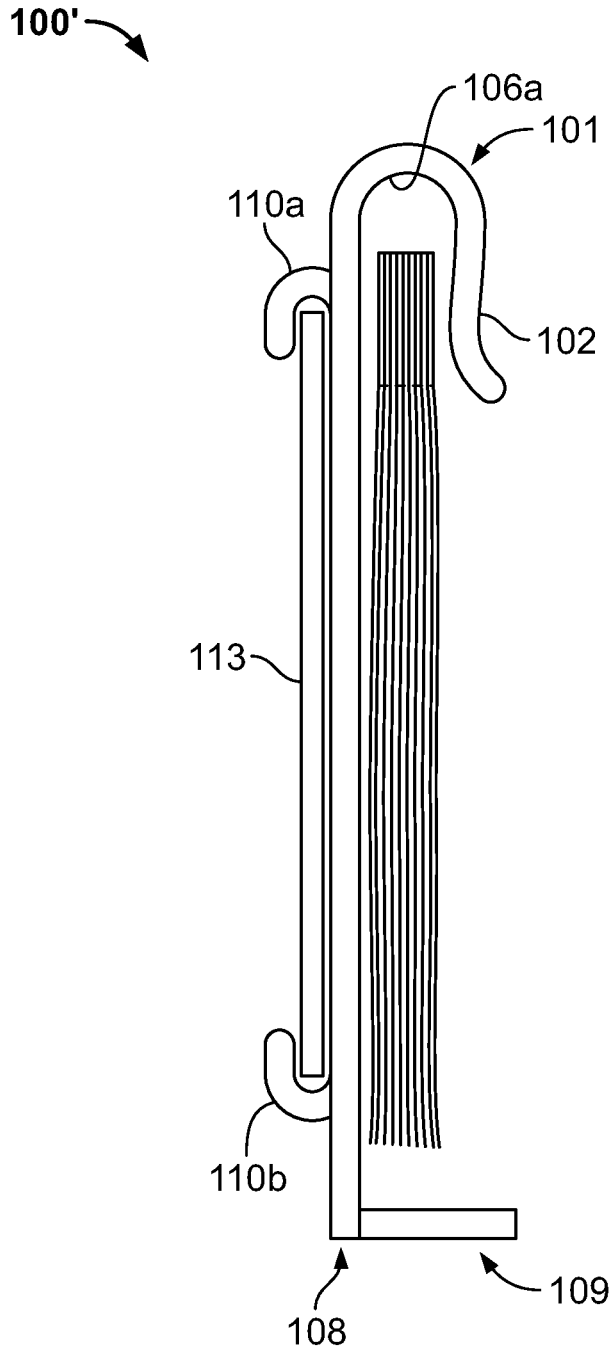
FIG. 12 is another embodiment twist-tie dispenser refill and a mounting plate.

In another embodiment twist-tie dispenser refill 100', as shown in FIG. 12, a rear surface of the base 101 could include a mounting member comprising a top extension 110*a* and a bottom extension 110*b* configured and arranged to receive a mounting plate 113, which is operatively connected to a mounting structure such as a plastic bag dispenser. The base 101 could be slid onto the mounting plate 113 with the top and bottom extensions 110*a*, 110*b* receiving the mounting plate 113. Also shown in FIG. 12, the base 101 could also include an optional bottom portion or extension 109 extending outward from the bottom 108 to provide protection to the bottom of the twist-tie cluster 120.

Figure 13:
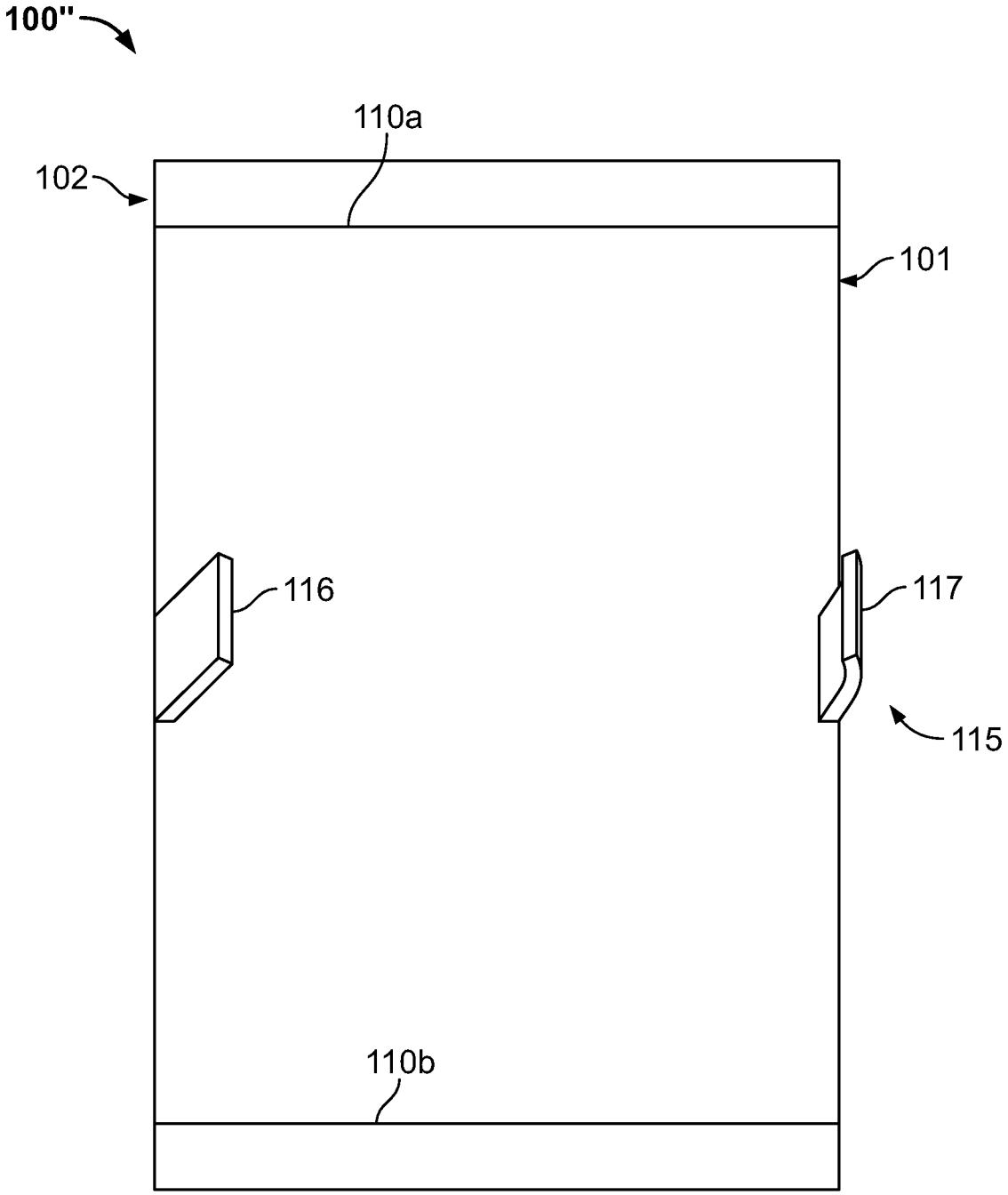
FIG. 13 is another embodiment base of a twist-tie dispenser refill including a securing mechanism.

In another embodiment twist-tie dispenser refill 100", as shown in FIG. 13, the base 101 could also include a securing mechanism 115 with a stop 116 proximate one side and a lock mechanism 117 proximate the opposing side so that the refill cannot be easily removed from the mounting plate 113. The mounting plate 113 is inserted between the top and bottom extensions 110*a* and 110*b* proximate the lock mechanism 117 and slid through the channels formed by the top and bottom extensions 110*a* and 110*b* until the mounting plate 113 is positioned between the stop 116 and the lock mechanism 117. After the lock mechanism 117 is in a lock position, the lock mechanism 117 must be released to slide the refill off the mounting plate 113. This provides a more secure refill and deters theft of the refill.

Figure 14:
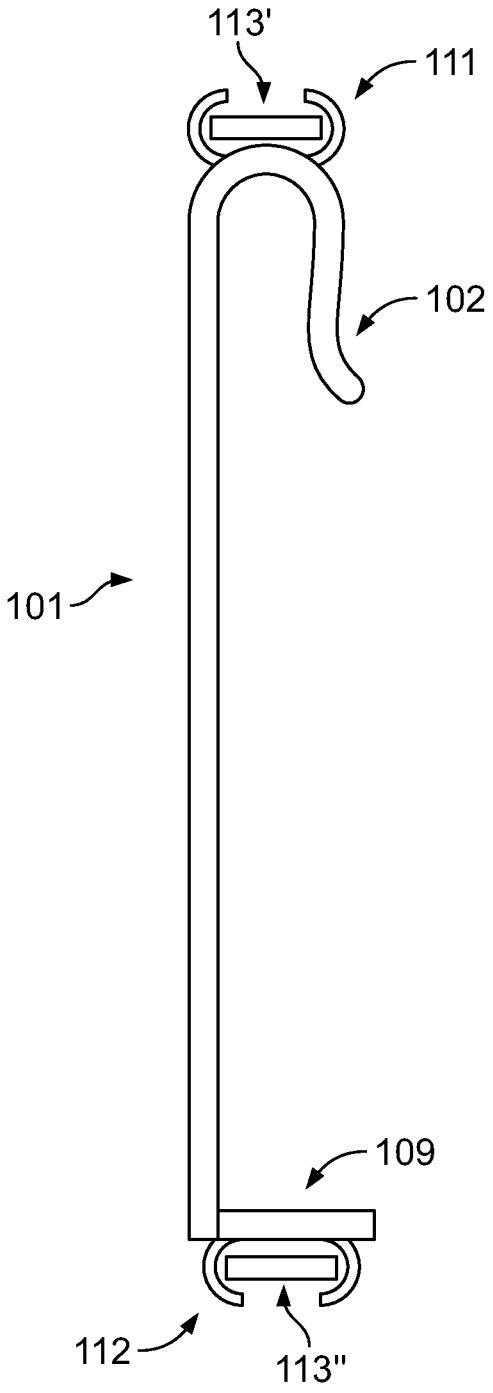
FIG. 14 is another embodiment base of a twist-tie dispenser refill including alternative mounting members.
Figure 15:
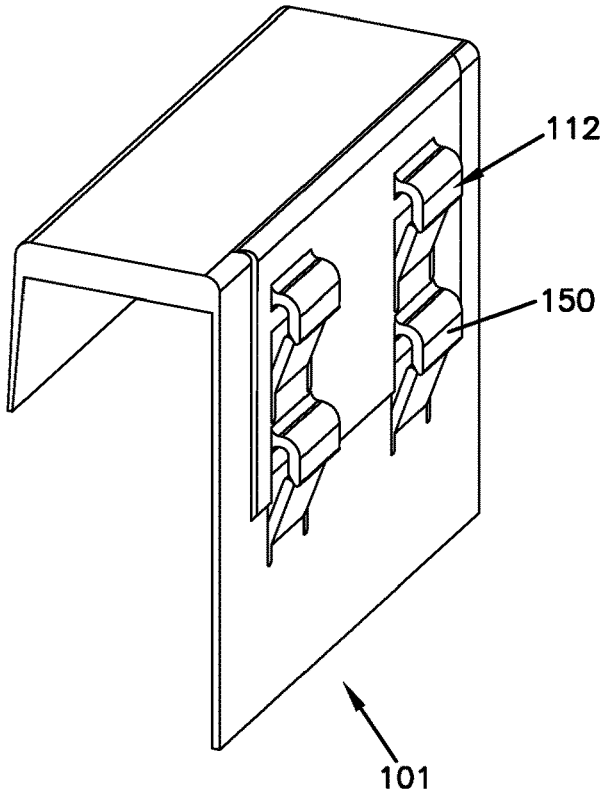
FIG. 15 is a rear perspective view of another embodiment base of a twist-tie dispenser refill including alternative mounting members.
Figure 16:
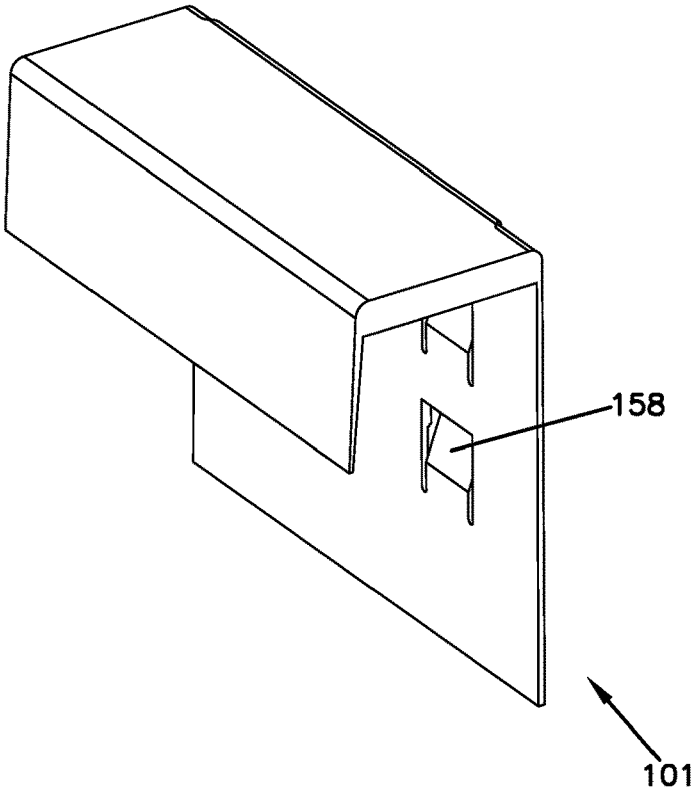
FIG. 16 is a front perspective view of the base shown in FIG. 15.
Figure 17:
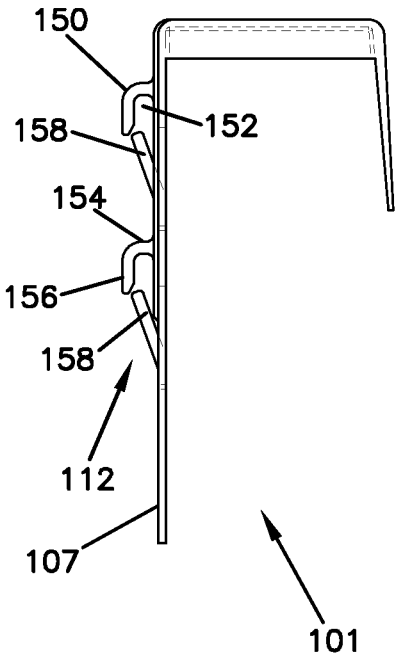
FIG. 17 is a side view of the base shown in FIG. 15.
Figure 18:
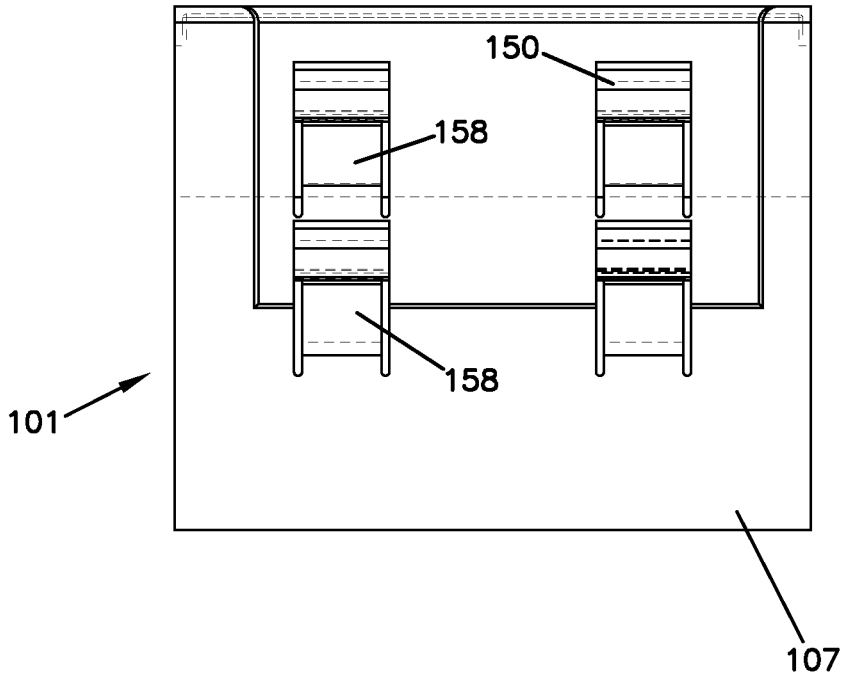
FIG. 18 is a rear view of the base shown in FIG. 15.
Figure 19:
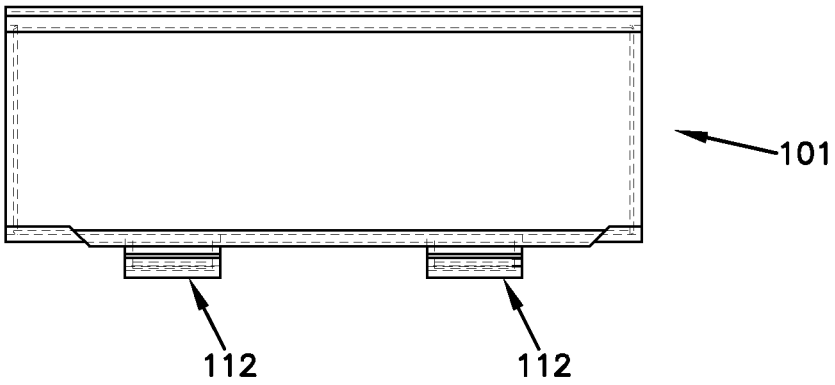
FIG. 19 is a top view of the base shown in FIG. 15.
Figure 20:
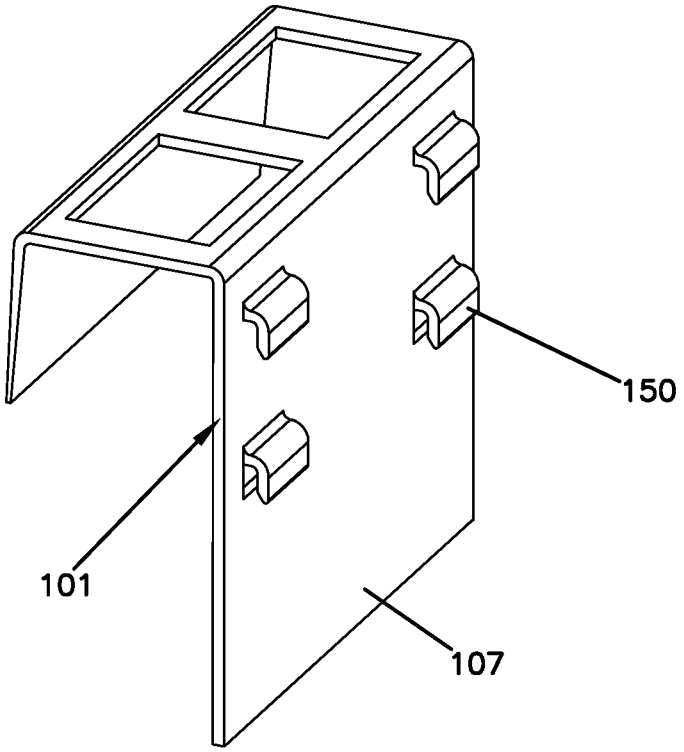
FIG. 20 is a rear perspective view of another embodiment base of a twist-tie dispenser refill including alternative mounting members.
Figure 21:
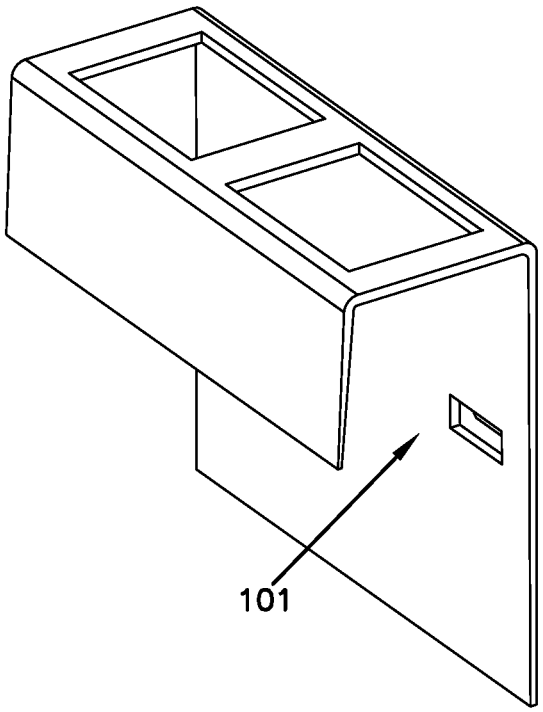
FIG. 21 is a front perspective view of the base shown in FIG. 20.
Figure 22:
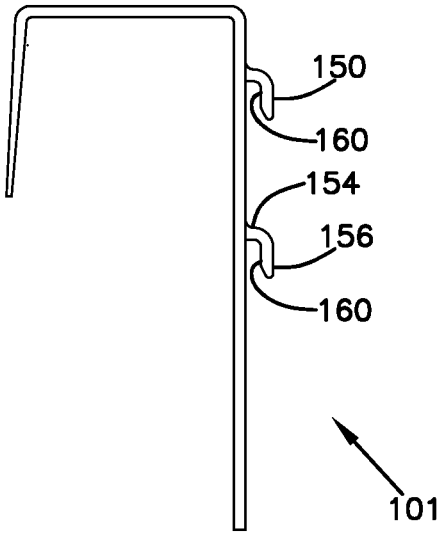
FIG. 22 is a side view of the base shown in FIG. 20.
Figure 23:
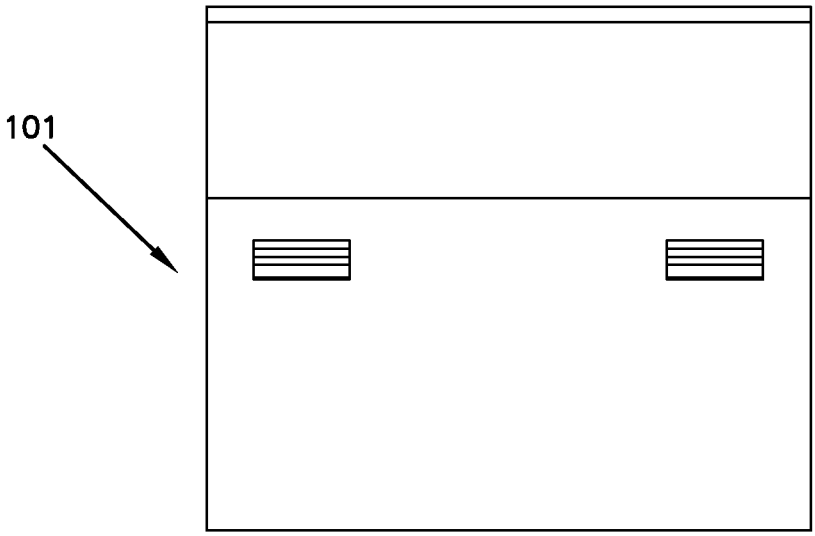
FIG. 23 is a front view of the base shown in FIG. 20.
Figure 24:
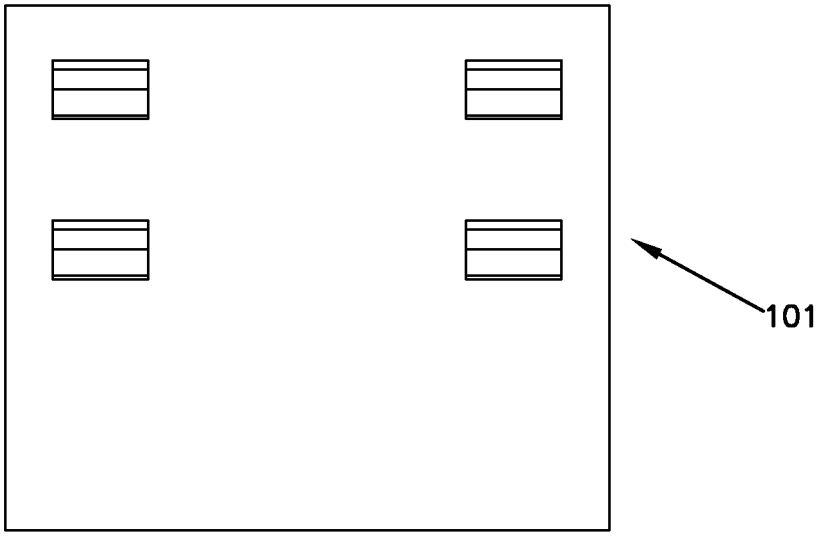
FIG. 24 is a rear view of the base shown in FIG. 20.
Figure 25:
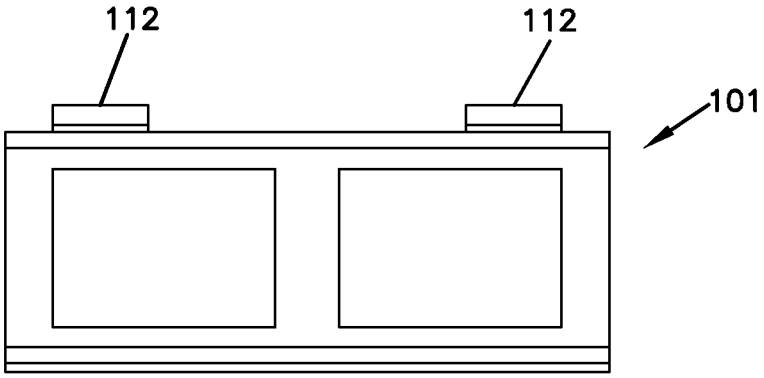
FIG. 25 is a top view of the base shown in FIG. 20.

In another embodiment twist-tie dispenser refill, as shown in FIG. 14, the base 101 could include alternative types of optional mounting members such as mounting members 111 operatively connected to the top of the base 101 and configured and arranged to receive a mounting plate 113', or mounting members 112 operatively connected to the bottom portion, or extension 109 configured and arranged to receive a mounting plate 113". One or more of these types of mounting members could be used, and it is recognized that other types of mounting members could be used depending upon the desired mounting orientation of the base. For example, mounting members proximate the top of the base could be used if it is desired for the base to hang downward relative to a mounting plate or surface, mounting members proximate the bottom of the base could be used if it is desired for the base to extend upward relative to a mounting plate or surface (e.g., table), and mounting members proximate the rear of the base could be used.

In another embodiment, a rod (not shown) could be inserted through a bore 106*a* formed between the top 103 of the top portion 102 and the connected top portion 122 of the twist-tie cluster 120. The rod could be configured and arranged to lock onto the mounting structure to secure the refill thereto.

Rather than simply refilling the twist-tie cluster, the present invention includes a base that is in effect integral with a twist-tie cluster. This has numerous benefits including biodegradable components, lower cost because a heavy plastic receiver is eliminated, cleaner appearance of the base because it is replaced with a new refill including a new base, the ability to match advertising on the base with advertising on the twist-ties, etc.

Figure 27:
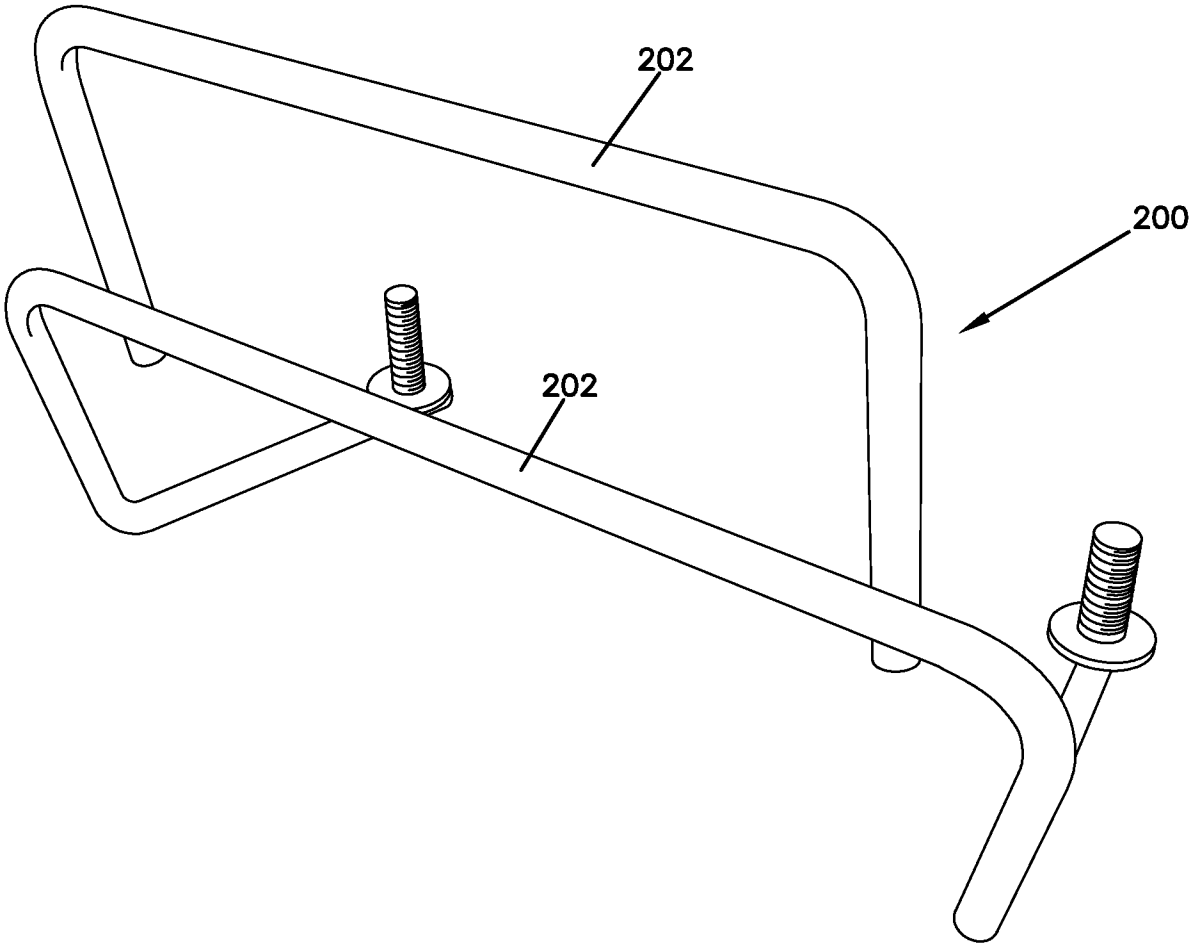
Figure 28:
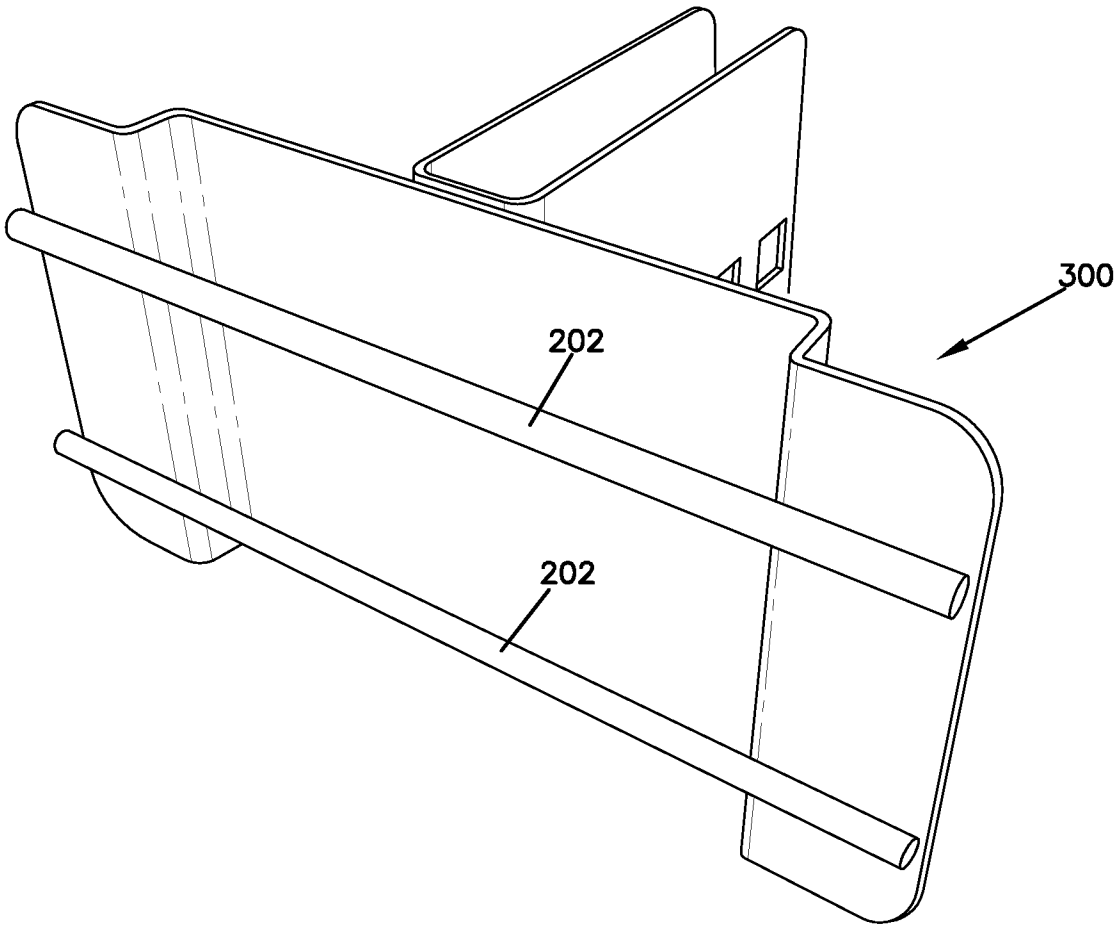
FIG. 28 illustrates another example embodiment of a fixture to which twist-tie dispenser refills such as those shown in FIGS. 15-25 may be mounted.

FIGS. 15-19 illustrate another version of the base 101 for a twist-tie dispenser refill. The base 101 of the dispenser refill shown in FIGS. 15-19 includes an alternative embodiment of a mounting member 112 used for mounting the base 101 to a fixture 200. The mounting member 112, depicted, includes at least one extension 150. The extension 150 protrudes outwardly from the rear portion 107 of the base 101. The extension 150 defines a hook-like configuration and is configured to receive elongate, rod-like mounting structures 202 of a fixture 200 to which the twist-tie dispenser refill 100 is going to be mounted. Two examples of fixtures 200, 300 to which the base 101 may be mounted that include elongate rod-like mounting structures 202 are shown in FIGS. 27 and 28.

The at least one extension 150 can include a plurality of extensions 150 as shown in the depicted version of the base 101. In certain embodiments, the at least one extension 150 can include multiple rows of extensions 150 such as the version shown such that the twist-tie dispenser refill 100 can be mounted to fixtures that have parallel elongate rod-like mounting structures 202. The examples of fixtures 200, 300 shown in FIGS. 27 and 28 each include two parallel rod-like mounting structures 202. The rows of the extensions 150 of the base 101 are spaced apart in accordance with the spacing of the rod-like structures 202. Even though shown as including two parallel rod-like mounting structures 202, more or less rod-like mounting structures 202 may be provided on the fixtures 200, 300. According to one example embodiment, the rod-like structures 202 may be 3/16" in diameter and the spacing between the two rows of the rod-like mounting structures 202 may be 1¼".

According to the depicted embodiment, the hook-like configuration defined by each extension 150 defines a pocket 152 formed by an upper stop portion 154 and a vertical retention portion 156. In the depicted embodiment of the base 101, the entrance of the pocket 152 is blocked by a flexible cantilever tab 158. The cantilever tab 158 is configured such that it is to be elastically flexed out of the way when receiving the elongate rod-like mounting structure 202 into the pocket 152. Once the rod 202 is past the cantilever 158 and enters the pocket 152 to abut the upper stop portion 154, the cantilever 158 flexes back into original position. The flexible cantilever 158 is configured to prevent or limit removal of the rod 202 from the mounting member 112 of the twist-tie dispenser refill 100. Although depicted in the present embodiment as including cantilever members 158, in other embodiments, the base 101 may be configured with just extensions 150 that do not have opposing cantilever members 158 to prevent removal. In such embodiments (an example of which is shown in FIGS. 20-25), the bases 101 of the twist-tie dispenser refills 100 may simply be hung from the rod-like structures 202 of the fixtures 200, 300. In the embodiment of the twist-tie dispenser refill 100 shown in FIGS. 20-25, the twist-tie dispenser refill 100 can simply be removed by lifting the twist-tie dispenser refill 100 from the rod(s) 202 without having to manipulate any cantilever members.

In certain embodiments, the rod-like mounting structures 202 may be received within the pockets 152 formed by the extensions 150 via a snap-fit interlock. In such embodiments, the vertical retention portion 156 of the extension 150 may define a tab 160 that acts to retain the rod 202 in the pocket 152. In such an embodiment, when the rod 202 is entering the pocket 152 formed by the extension 150, the rod 202 contacts the tab 160 and flexes out the vertical retention portion 156. After the rod 202 clears the tab 160, the vertical retention portion 156 can flex back to snap in the rod 202 within the pocket 152. The tabs 160 are shown in the version of the twist-tie dispenser refill 100 illustrated in FIGS. 20-25.

Figure 26:
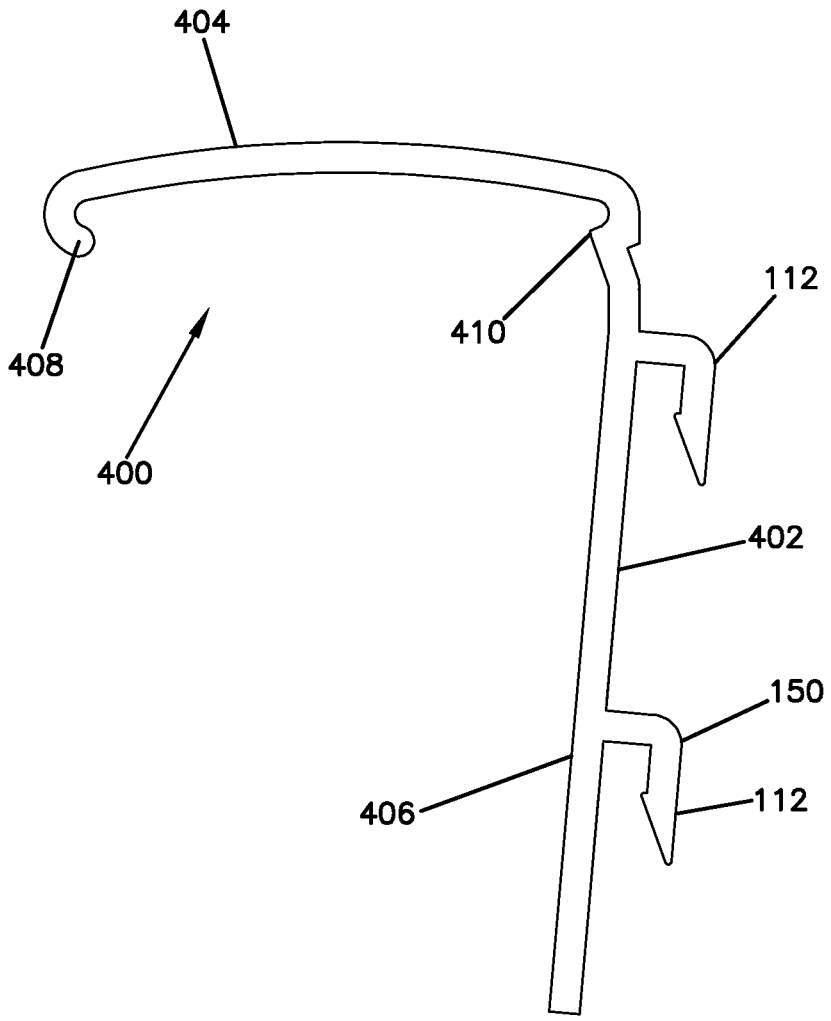
FIG. 26 is a side view of a converter clip structure that is configured to convert a preexisting twist-tie dispenser refill to a version that includes similar mounting members such as those shown in FIGS. 20-25.

FIG. 26 depicts a converter clip structure 400 that can be removably attached to a preexisting twist-tie dispenser refill to convert it to a version that provides a similar mounting arrangement such as those shown in FIGS. 15-25. The converter clip 400 may define extension(s) 150 and/or cantilever(s) 158 similar to those found in the mounting members 112 of the twist-tie dispenser refill 100 of FIGS. 15-25. The converter clip 400 is configured to be snapped over the U-shaped top portion 102 of the base 101 of a preexisting twist-tie dispenser refill 100 which does not normally include extensions protruding from the rear portion 107 of the base 101.

Still referring to FIG. 26, the converter clip 400 may define a generally L-shaped body 402 including a top horizontal portion 404 and a vertical portion 406 that extends down from the top horizontal portion 404. The vertical portion 406 includes the mounting member(s) 112 for attachment to fixtures such as fixtures 200, 300. The top horizontal portion 404 may define a downwardly hanging lip 408 at a front edge thereof. The converter clip 400 may also define another lip 410 at an inner side of the vertical portion 406 that is configured to oppose the lip 408 at the front edge. The two opposing lips 408, 410 may be used to snap-fit the converter clip structure 400 to the U-shaped top portion 102 of the base 101. For example, the lips 408, 410 may engage flanges defined at an outer perimeter of the top 103 of the top portion 102 of the base 101 of a preexisting twist-tie dispenser refill 100. Such flanges may be defined at the front and back edges of the top 103 of the top portion 102 for snap-fitting with the lips 408, 410 of the converter clip 400.

As noted above, the converter clip 400 may define mounting members 112 such as those shown on twist-tie dispenser refills 100 of FIGS. 15-25, wherein the mounting members 112 are provided by extensions 150. The extensions 150 defined by the converter clip 400 may be provided in parallel rows that match the spacing of the rod-like structures 202 that may be found on the fixtures 200, 300. In certain embodiments of the converter clip 400, the parallel extensions 150 may extend the entire width of the converter clip 400.

The above specification, examples, and data provide a complete description of the manufacture and use of the composition of embodiments of the invention. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the invention. Therefore, it is manifestly intended that this invention be limited only by the claims and the equivalents thereof.

The invention claimed is:

1. A base for a twist-tie dispenser refill, the base comprising:

a base portion and a rear portion, the base portion configured to receive a twist-tie cluster and the rear portion extending from the base portion;

at least one mounting member protruding from the rear portion, the at least one mounting member configured for mounting the base to a fixture, wherein the at least one mounting member defines a hook configuration with a stop portion and a vertical retention portion, the at least one mounting member configured to receive a mounting structure of the fixture in the form of a rod.

2. The base of claim 1, wherein the at least one mounting member protruding from the rear portion includes at least two mounting members aligned along a horizontal row.

3. The base of claim 2, wherein the at least one mounting member protruding from the rear portion includes at least two parallel rows of mounting members.

4. The base of claim 1, wherein the at least one mounting member defines a pocket for receiving the mounting structure of the fixture that is in the form of a rod, the rear portion defining at least one flexible cantilever tab corresponding to the at least one mounting member that is configured to block at least a portion of an entrance to the pocket such that the at least one flexible cantilever tab is configured to be elastically flexed to receive and remove the rod like mounting structure of the fixture that is in the form of a rod.

5. The base of claim 4, wherein the at least one mounting member protruding from the rear portion and the at least one corresponding cantilever tab include at least two of the mounting members and two of the corresponding cantilever tabs aligned along a horizontal row.

6. The base of claim 1, wherein the vertical retention portion of the at least one mounting member defines a tab protruding at least partially into a pocket defined by the at least one mounting member configured for receiving the mounting structure of the fixture that is in the form of a rod with a snap-fit interlock.

7. The base of claim 1, wherein the base is biodegradable.

8. The base of claim 1, wherein the base is made of extruded plastic.

9. The base of claim 1, wherein the base is made of corrugated cardboard.

* * * * *